US006946937B2

(12) United States Patent
Donce

(10) Patent No.: US 6,946,937 B2
(45) Date of Patent: Sep. 20, 2005

(54) ELECTROMAGNETIC ACTUATOR

(75) Inventor: Lucien Donce, Magny en Vexin (FR)

(73) Assignee: Johnson Controls Automotive Electronics, Osny (FR)

( * ) Notice: Subject to any disclaimer, the term of this patent is extended or adjusted under 35 U.S.C. 154(b) by 92 days.

(21) Appl. No.: 10/466,272

(22) PCT Filed: Jan. 10, 2002

(86) PCT No.: PCT/FR02/00074

§ 371 (c)(1),
(2), (4) Date: Jul. 15, 2003

(87) PCT Pub. No.: WO02/056321

PCT Pub. Date: Jul. 18, 2002

(65) Prior Publication Data

US 2004/0051608 A1 Mar. 18, 2004

(30) Foreign Application Priority Data

Jan. 15, 2001 (FR) ..... 01 00459

(51) Int. Cl.[7] ..... H01F 5/00

(52) U.S. Cl. ..... 335/282; 123/90.11; 336/192; 251/129.01

(58) Field of Search ..... 335/255, 256, 335/266, 268, 278, 282; 336/192; 251/129.01, 129.09, 129.1, 129.15, 129.16, 129.21, 129.22; 123/90.11

(56) References Cited

U.S. PATENT DOCUMENTS 4,898,360 A * 2/1990 VonHayn et al. ..... 251/129.01
5,040,853 A * 8/1991 Burgdorf et al. ..... 303/119.3
5,189,782 A * 3/1993 Hickey ..... 29/602.1
5,488,340 A 1/1996 Maley et al.
5,853,231 A * 12/1998 Iwamura et al. ..... 303/119.2
5,941,282 A * 8/1999 Suzuki et al. ..... 137/884
6,095,489 A * 8/2000 Kaneko et al. ..... 251/129.15

FOREIGN PATENT DOCUMENTS

EP 0 616 670 B1 9/1994
EP 0 893 620 B1 1/1999
EP 0 932 178 A2 7/1999

OTHER PUBLICATIONS

PCT/FR 02/00074 International Search Report, received Sep. 8, 2003, 2 pages.

* cited by examiner

*Primary Examiner*—Ramon M. Barrera
(74) *Attorney, Agent, or Firm*—Foley & Lardner LLP

(57) ABSTRACT

The invention provides an electromagnetic actuator comprising at least two coils (5, 6) associated with ferromagnetic cores (11) and disposed facing each other, and a moving element (1) extending between the coils (5, 6) and associated with an actuator rod (2), the coils (5, 6) comprising conductors (7) with ends (16) extending transversely to an axis (100) of the coils (5, 6) and fixed directly to pins (21) carried by a connection plate (18) fixed on one side (7) of the coils (5, 6) and including a connection circuit (24) providing connections with a connector (25) also carried by the connection plate (18).

21 Claims, 3 Drawing Sheets

ELECTROMAGNETIC ACTUATOR

CROSS-REFERENCE TO RELATED PATENT APPLICATIONS

This application is a National Stage of Application PCT/FR02/00074, filed Jan. 10, 2002, incoporated herein by reference in its entirety.

BACKROUND

The invention relates to an electromagnetic actuator.

In reciprocating engines presently under study, it is envisaged that the admission and exhaust valves will be actuated by electromagnetic actuators.

In general, an electromagnetic actuator comprises at least two coils associated with ferromagnetic cores and disposed facing each other, and a moving element that extends between the coils and is associated with an actuator rod. The actuator rod co-operates with the end of the stem of a valve in order to actuate it.

When assembling such actuators, the coils are not secured to each other. They must therefore be placed one by one in the actuator housing, which increases assembly time. Flexible cables are then fixed to the coils in order to connect them to a power supply connector. Such connection is made difficult by the fact that the coils are already in the actuator housing, so the ends of the conductors constituting the coils are difficult to access.

Alternatively, if assembly is begun by connecting the coils to the connector, then it becomes awkward to take the set of coils and place them in the actuator housing.

SUMMARY

In the invention, the coils comprise conductors having ends extending transversely to a coil axis and directly fixed to pins carried by a plate fixed on one side of the coils and including a connection circuit providing a connection with a connector also carried by the plate.

Thus, the plate serves both to provide electrical connection between the coils and the connector, and mechanical fastening of the coils relative to one another. This disposition makes it possible to assemble the card to the coils away from the actuator housing, and then take the assembly as built up in this way to the housing. This simplifies assembly of the actuator considerably.

Advantageously, each end of a conductor extends through a hole in the plate and opens out adjacent to a pin on a face of the plate opposite from the coils.

Thus, the end of the conductor is automatically positioned facing a pin while it is being inserted in the corresponding hole, and can thus be soldered to the pin by a hot clamp whose movements are not impeded by the coils.

Advantageously, the coils are covered in insulating material having external projections to which the connection plate is fixed. The coils also have spacers that bear against one another to maintain spacing between the coils. The spacers are preferably integral with the insulating material, and are formed by the external projections.

In an embodiment in which the actuator comprises four coils associated in two adjacent pairs, the coils in corresponding positions in each pair have ferromagnetic cores carried by a common ferromagnetic support. Putting the coils into place on the common support thus begins the process of mechanically securing the two pairs of coils.

In another aspect of the invention, the ferromagnetic cores project from the coils beside the moving element. These ferromagnetic cores thus form an abutment for the moving element, which prevents the coils being damaged.

BRIEF DESCRIPTION OF THE DRAWINGS

Other characteristics and advantages of the invention appear more clearly in the light of the following description of a particular non-limiting embodiment of the invention described with reference to the figures, in which.

DETAILED DESCRIPTION OF EXEMPLARY EMBODIMENTS

Figure 1:
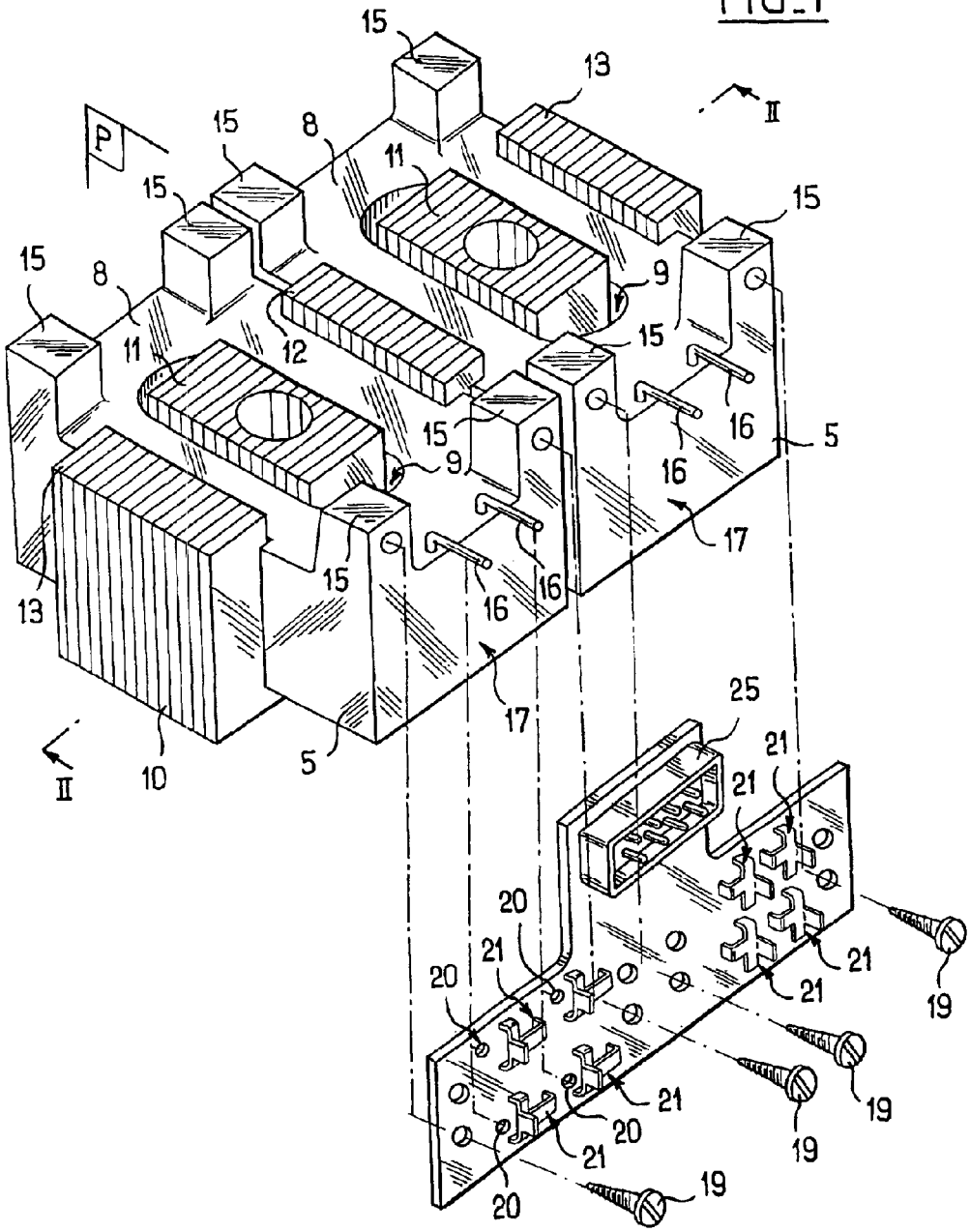
FIG. 1 is an exploded perspective view of a portion of an actuator of the invention.
Figure 2:
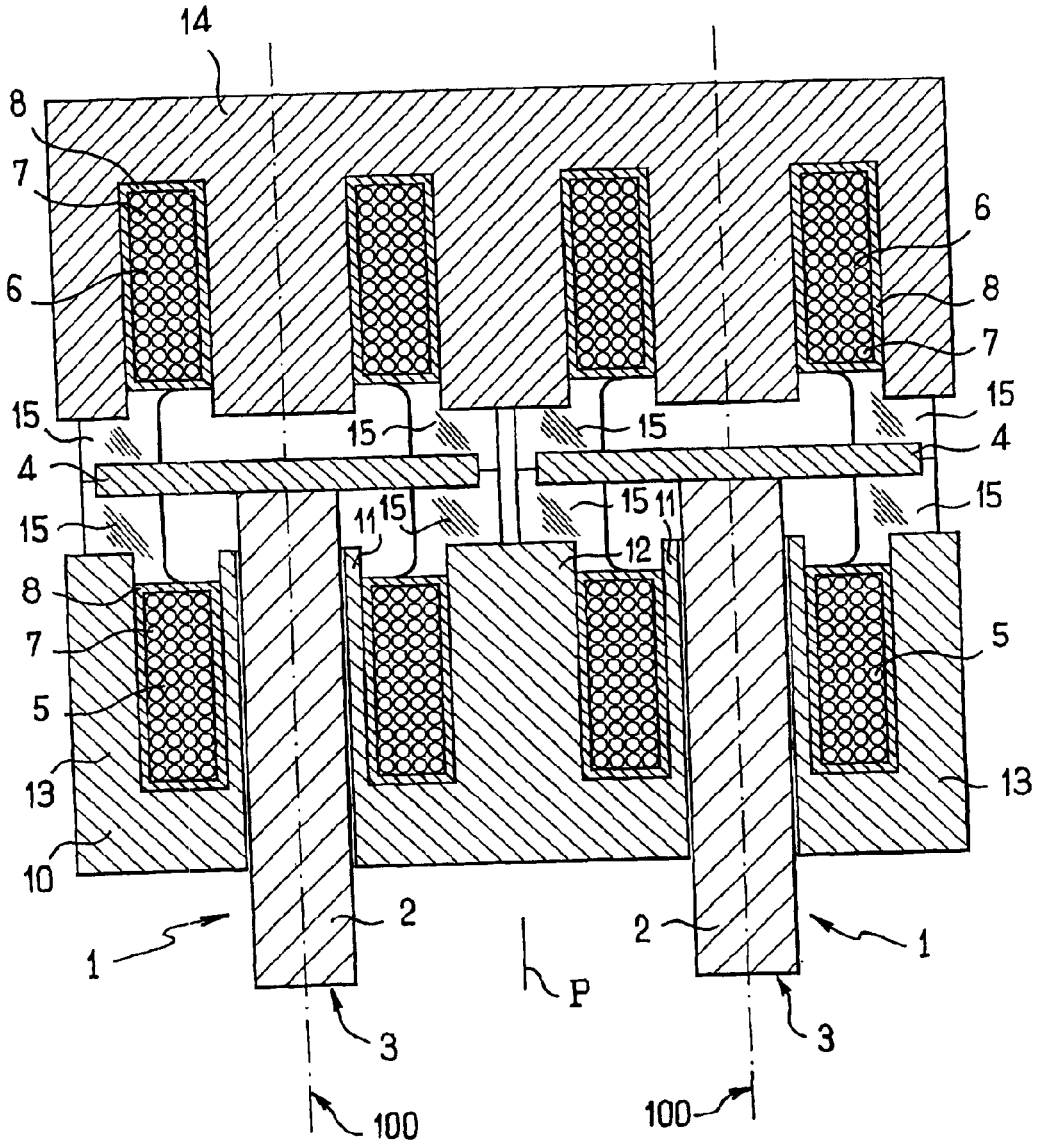
FIG. 2 is a section view of the actuator on II–I of FIG. 1.
Figure 3:
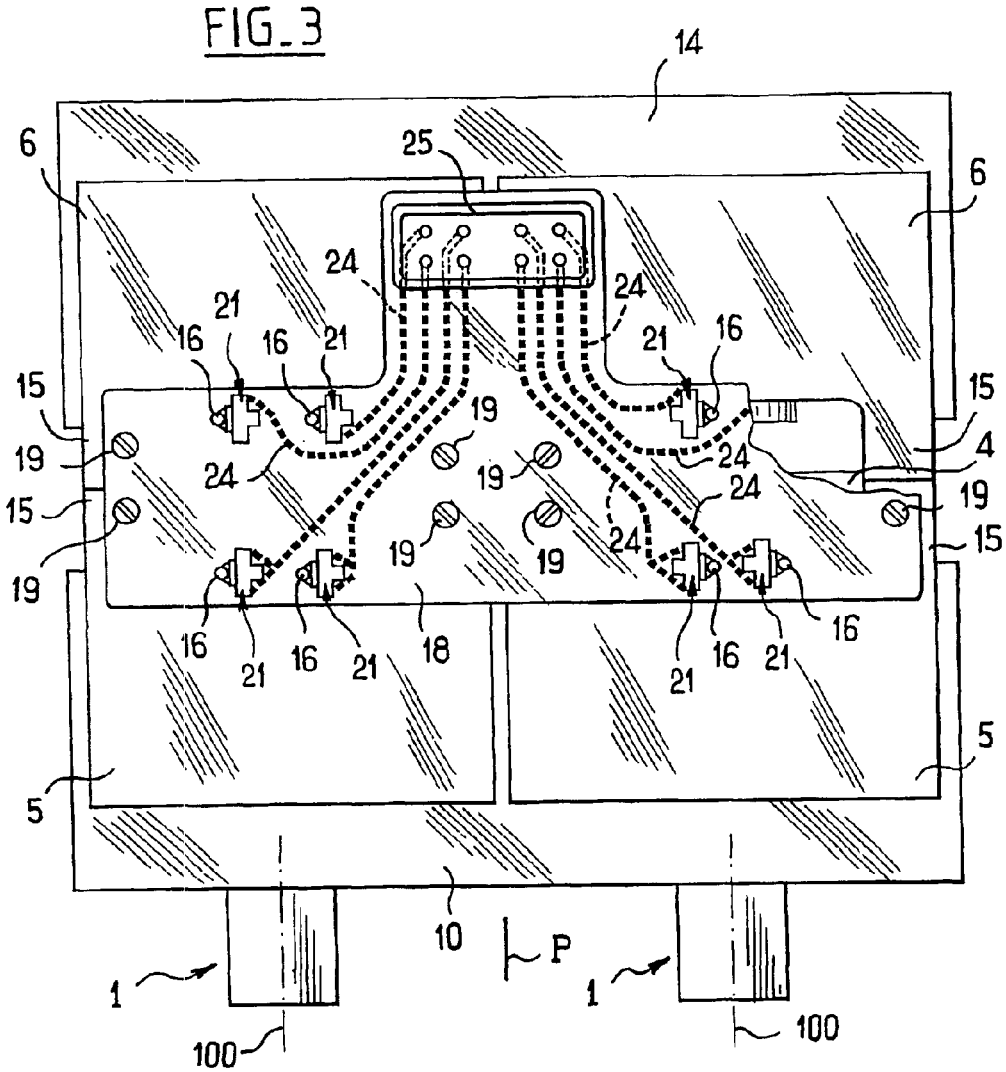
FIG. 3 is a front view of the actuator of FIGS. 1 and 2 after assembly.
Figure 4:
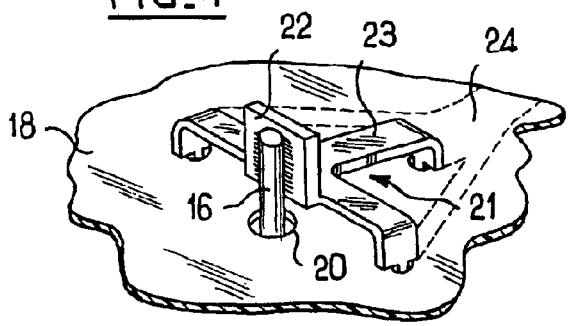
FIG. 4 is an enlarged perspective view of a connection pin at one end of a conductor.

The actuator described herein is suitable for controlling the opening and closing of two valves (not shown) having parallel axes. The actuator is substantially symmetrical about a plane P defining a boundary between actuator components associated with controlling different valves.

The actuator comprises two moving elements 1 each mounted on the actuator to slide along a respective axis 100. Each of these moving elements 1 comprises an actuator rod or plunger 2 having one end 3 projecting from the actuator to co-operate with the end of the stem of a valve.

The other end of the plunger 2 is secured to an armature 4 extending perpendicularly to the axis 100 and constrained to move between two coils 5 and 6 faced facing each other along the axis 100.

Each coil comprises a conductor 7 embedded by molding in an insulating material 8 forming a substantially rectangular block, the conductor 7 being wound in such a manner as to leave a central hole 9 through the coil.

The two coils 5 are engaged as a force-fit on a common support 10 made of laminations of ferromagnetic material stacked on one another. The support 10 has cores 11 extending in the central holes 9 of the coils 5. The cores 11 are pierced to allow the plungers 2 to pass through. The support 10 also comprises a central web 12 and two end webs 13 on either side of the coils 5.

The two coils 6 are engaged as a force-fit on a support 14 entirely similar to the support 10, with the exception of the cores of the coils 6 which are not pierced.

The cores 11 and the webs 12, 13 of the supports 10 and 14 project from the facing faces of the coils 5 and 6 so as to form abutments for the armatures 4 when they move.

Projections 15 are molded out of the insulating material 8 so as to project from the facing faces of the coils 5 and 6. The projections 15 of one coil form spacers which co-operate with the projections 15 of the facing coil so as to maintain a determined spacing between the coils.

On each coil, the ends 16 of the conductor 7 project by extending perpendicularly from a side face 17 of the coil.

The side faces 17 of the four coils form a support plane for a printed circuit 18 which is fixed to each coil by means of screws 19 each screwed into a respective projection of a coil.

Each conductor end 16 extends into a hole 20 of the printed circuit 18 and comes out in the vicinity of a pin 21 on a face of the printed circuit card remote from the coils.

Each pin 21 has a portion 22 which is parallel to the conductor end 16 and which is soldered thereto. This portion 22 is connected in stable manner to the printed circuit 18 by means of a tripod 23.

The ends of the tripod 23 pass through the printed circuit 18 to be electrically connected with conductor tracks 24 made on the face of the printed circuit facing the coils. The conductor tracks 24 form a connection circuit connecting the conductor ends 16 to a connector 25 carried by the printed circuit 18.

The procedure for assembling the actuator is as follows:

the coils 5 are fitted on the support 10, and then the coils 6 are fitted on the support 14;

the moving elements 1 are threaded through the holes in the support 10, and then the two coil assemblies as built up in this way are presented to each other so as to cause the projections 15 of each coil to co-operate with the projections 15 of the facing coil of the other assembly;

the printed circuit 18 is presented and screwed to the side faces 17 of the coils disposed in this way; and each conductor end 16 is soldered to the adjacent pin 21, e.g. by means of a hot clamp that delivers solder. This operation is made easier by the fact that the pins 21 are on a face of the printed circuit 18 that is easily accessible, and by the fact that the pins 21 are far enough apart from one another to make it easy to engage such a clamp.

All of the ends 16 are thus directly wired to the connector 25 without there being any need to extend any of them by means of a flexible cable. In addition, the four coils are secured mechanically to one another by means of the printed circuit 18 and can thus be transported as a block for placing in a housing (not shown) of the actuator.

Furthermore, all of the components (pins, connector) of the printed circuit 18 are situated on the same face thereof and can therefore be flow-soldered to the printed circuit 18 prior to the printed circuit being assembled to the coils.

The invention is not limited to the particular embodiment described above, but on the contrary covers any variant coming within the scope of the invention as defined by the claims.

In particular, although the actuator is described as having a printed circuit 18, it is possible to use a plate of synthetic material having conductors embedded therein, which conductors are made by stamping a metal sheet in order to form the connection circuit.

Although the actuator is described with a support common to two coils, it is possible to replace such a support by two independent ferromagnetic cores, and to join together the two coils fitted with these cores by connection means on their facing faces.

Although the external projections of the coils are used in this case as coil spacers, it is possible to make provision for using spacers that are fittings separate from the external projections.

Although the printed circuit described is screwed to the coils, other fasteners could be used, for example it could be snap-fastened or bonded by adhesive.

It is also possible to provide an additional structural member between the coils, for example straps fixed to the coils on their side face remote from the connection circuit.

Although the printed circuit 18 is described as carrying only the connector 25 and the pins 21, it could also carry electronic components for managing the supply of power to the conductors of the coils. It is also possible for it to carry connections to a sensor associated with the moving elements 1.

What is claimed is:

1. An electromagnetic actuator comprising:

at least two coils associated with ferromagnetic cores disposed facing each other; and a moving element extending between the coils and associated with an actuator rod;

wherein the coils comprise conductors having ends extending transversely to an axis of the coils and fixed directly to pins carried by a connection plate fixed on one side of the coils and carrying a connection circuit making a connection with a connector also carried by the connection plate.

2. An electromagnetic actuator according to claim 1, wherein each end of a conductor extends in a hole through the connection plate and projects adjacent to a pin on a face of the connection plate remote from the coils.

3. An electromagnetic actuator according to claim 1, wherein the coils are covered in insulating material including external projections to which the connection plate is fixed.

4. An electromagnetic actuator according to claim 1, wherein the coils include spacers bearing against one another to maintain spacing between the coils.

5. An electromagnetic actuator according to claim 4, wherein the spacers are formed by the external projections.

6. An actuator according to claim 1, having four coils associated as two adjacent pairs, and wherein the coils in corresponding positions in each of the pairs have ferromagnetic cores carried by a common support.

7. An actuator according to claim 1, wherein the ferromagnetic cores project from the coils beside the moving element.

8. An electromagnetic actuator for an automobile, comprising:

at least two coils associated with ferromagnetic cores disposed in proximity of each other, the at least two coils comprising conductors having ends;

a moving element configured to be moved by at least one of the at least two coils; and a connection plate to which the ends are fixed, the connection plate carrying a connection circuit that forms an electrical connection between a connector carried by the connection plate and the ends;

wherein the ends are connected to pins of the connection plate.

9. The actuator of claim 8, wherein the moving element is configured to control movement of an engine valve.

10. The actuator of claim 9, wherein the moving element is coupled to a rod which is coupled to the engine valve whereby movement of the moving element results in movement of the engine valve.

11. The actuator of claim 8, wherein at least two of the at least two coils are disposed facing each other.

12. The actuator of claim 8, wherein the connection plate is fixed to a side of at least one of the at least two coils.

13. The actuator of claim 8, wherein the connection plate comprises a printed circuit board carrying a printed circuit.

14. An electromagnetic actuator for an automobile, comprising:

at least two coils associated with ferromagnetic cores disposed in proximity of each other, the at least two coils comprising conductors having ends;

a moving element configured to be moved by at least one of the at least two coils; and a connection plate to which the ends are fixed, the connection plate carrying a connection circuit that forms an electrical connection between a connector carried by the connection plate and the ends;

wherein the ends of the at least two coils extend transverse to an axis of the coil from which they extend.

15. The actuator of claim 14, wherein the moving element is configured to control movement of an engine valve.

16. The actuator of claim 14, wherein the connector plate comprises a printed circuit board carrying a printed circuit.

17. A method for assembling a valve actuator, comprising:

placing a moving element through a first coil;

connecting first conductor ends of the first coil to a connector plate whereby the first conductor ends are electrically coupled to a connector carried by the connector plate; and connecting second conductor ends of a second coil to the connector plate whereby the second conductor ends are electrically coupled to the connector;

fitting the first coil on a first support;

fitting the second coil on a second support; and presenting the coils to each other such that projections of the first cooperate with projections of the second coil.

18. The method of claim 17, further comprising arranging the coils such that the connector plate can be connected to the first conductor ends and the second conductor ends by sliding the first conductor ends and the second conductor ends through holes in the connector plate.

19. The method of claim 17, further comprising:

placing a second moving element through a third coil;

connecting third conductor ends of the third coil to a connector plate whereby the third conductor ends are electrically coupled to the connector carried by the connector plate; and connecting fourth conductor ends of a fourth coil to the connector plate whereby the fourth conductor ends are electrically coupled to the connector.

20. The method of claim 19, further comprising:

fitting the first coil on a support and fitting the third coil on the support.

21. The method of claim 17, further comprising fixing a first face of the connector plate to a side face of the first and second coils, wherein connecting the first conductor ends comprises connecting the first conductor ends on a second face of the connector plate that is opposite the first face and connecting the second conductor ends comprises connecting the second conductor ends on the second face of the connector plate.

* * * * *

UNITED STATES PATENT AND TRADEMARK OFFICE

CERTIFICATE OF CORRECTION

PATENT NO. : 6,946,937 B2
DATED : September 20, 2005
INVENTOR(S) : Lucien Donce

It is certified that error appears in the above-identified patent and that said Letters Patent is hereby corrected as shown below:

Column 5,
Line 21, between "first" and "cooperate," insert -- coil --.

Signed and Sealed this

Thirty-first Day of January, 2006

JON W. DUDAS
*Director of the United States Patent and Trademark Office*